US006308653B1

(12) United States Patent
Geraci

(10) Patent No.: US 6,308,653 B1
(45) Date of Patent: Oct. 30, 2001

(54) SELF ADJUSTING BOAT COVER SUPPORT POLE

(76) Inventor: Donald J. Geraci, 6590 Springdale Rd., Cincinnati, OH (US) 45247

( * ) Notice: Subject to any disclaimer, the term of this patent is extended or adjusted under 35 U.S.C. 154(b) by 0 days.

(21) Appl. No.: 09/648,678

(22) Filed: Aug. 25, 2000

(51) Int. Cl.[7] ..... B63B 17/00
(52) U.S. Cl. ..... 114/361
(58) Field of Search ..... 114/361, 343; 248/600, 622, 354.1; 135/99, 141, 907

(56) References Cited

U.S. PATENT DOCUMENTS

| | | | | |
|---|---|---|---|---|
| 306,581 | * | 10/1884 | Chase | 248/600 |
| 1,044,523 | * | 11/1912 | Hedman | 248/600 |
| 2,390,986 | * | 12/1945 | Burns | 114/361 |
| 2,474,031 | * | 6/1949 | Burns | 114/361 |
| 5,031,566 | * | 7/1991 | Switzer | 114/361 |
| 5,228,408 | | 7/1993 | Jannausch . | |
| 5,238,213 | * | 8/1993 | Pool | 248/354.1 |
| 5,479,872 | * | 1/1996 | Hulett | 114/361 |
| 5,490,532 | | 2/1996 | Mallookis et al. . | |
| 5,590,674 | | 1/1997 | Eppenbach . | |
| 5,593,239 | | 1/1997 | Sallee . | |

* cited by examiner

*Primary Examiner*—Stephen Avila
(74) *Attorney, Agent, or Firm*—Henderson & Sturm LLP

(57) ABSTRACT

A self-adjusting boat cover support pole in combination with a flexible boat cover. The support pole includes a tubular base leg having a spring disposed in its interior cavity adjacent its lower end. A first tubular extension leg is telescopically received in the base leg with its lower end contacting and upwardly biased by the spring while its upper end contracts and supports the boat cover. Additional tubular extension legs may be telescopically connected and adjustably locked at any desired position to give an appropriate overall length. The support pole holds the boat cover in a resiliently taut condition to facilitate attaching the cover to the boat hull, to eliminate water cupping, and to minimize the potential for tearing of the cover.

1 Claim, 2 Drawing Sheets

SELF ADJUSTING BOAT COVER SUPPORT POLE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of support poles, and more particularly to a self-adjusting boat cover support pole.

2. Description of Related Art

As can be seen by reference to the following U.S. Pat. Nos. 5,228,408; 5,490,532; 5,590,674 and 5,593,239, the prior art is replete with myriad and diverse support poles.

While all of the aforementioned prior art constructions are more than adequate for the basic purpose and function for which they have been specifically designed, they are uniformly deficient with respect to their failure to provide a simple, efficient, and practical boat cover support pole. Currently known manually adjustable boat cover support poles have several disadvantages. When snapping down the boat cover using these support poles, the cover may be too loose or too tight requiring the boater to climb back into the boat under the hot cover to adjust the pole manually. Also, with this pole, rain will cause the cover to stretch causing cupping of water and possible tearing of the cover. Further, while traveling at 50 miles per hour or greater, the current pole at a set position allows the cover to stretch and blow and the bow pole may vibrate out of position and cause tearing.

As a consequence of the foregoing situation, there has existed a longstanding need for a new and improved self-adjusting boat cover support pole and the provision of such a construction is a stated objective of the present invention.

BRIEF SUMMARY OF THE INVENTION

Briefly stated, the present invention provides a self-adjusting boat cover support pole in combination with a flexible boat cover. The support pole includes a tubular base leg having a spring disposed in its interior cavity adjacent its lower end. A first tubular extension leg is telescopically received in the base leg with its lower end contacting and upwardly biased by the spring while its upper end contracts and supports the boat cover. Additional tubular extension legs may be telescopically connected and adjustably locked at any desired position to give an appropriate overall length. The support pole holds the boat cover in a resiliently taut condition to facilitate attaching the cover to the boat hull, to eliminate water cupping, and to minimize the potential for tearing of the cover.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
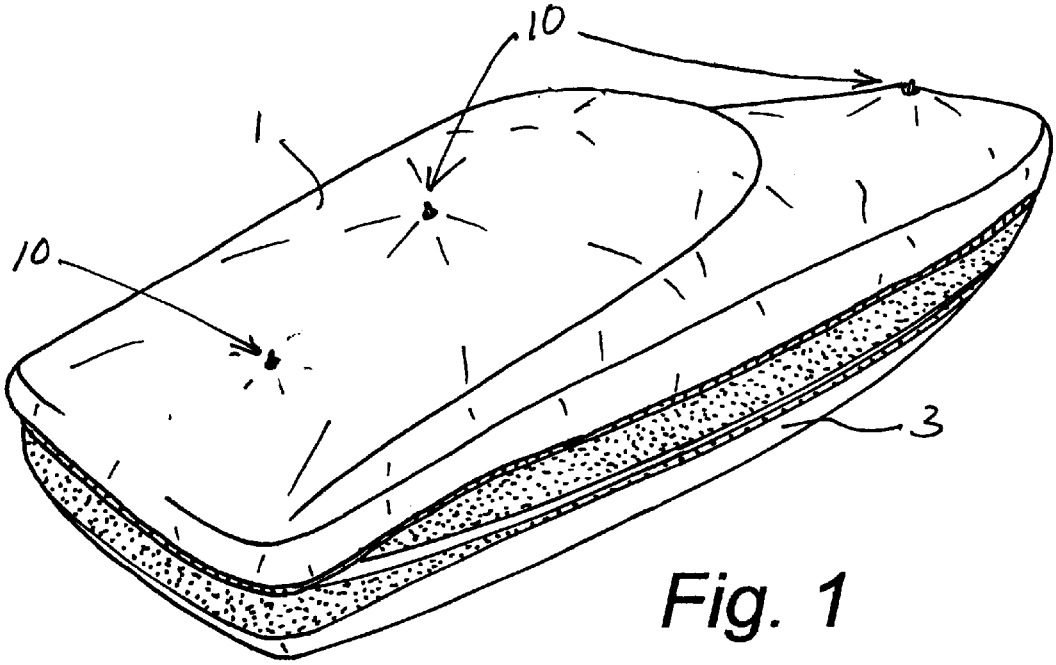
FIG. 1 is a perspective view of a boat cover held in a resiliently taut condition by the self-adjusting support poles of the present invention.
Figure 2:
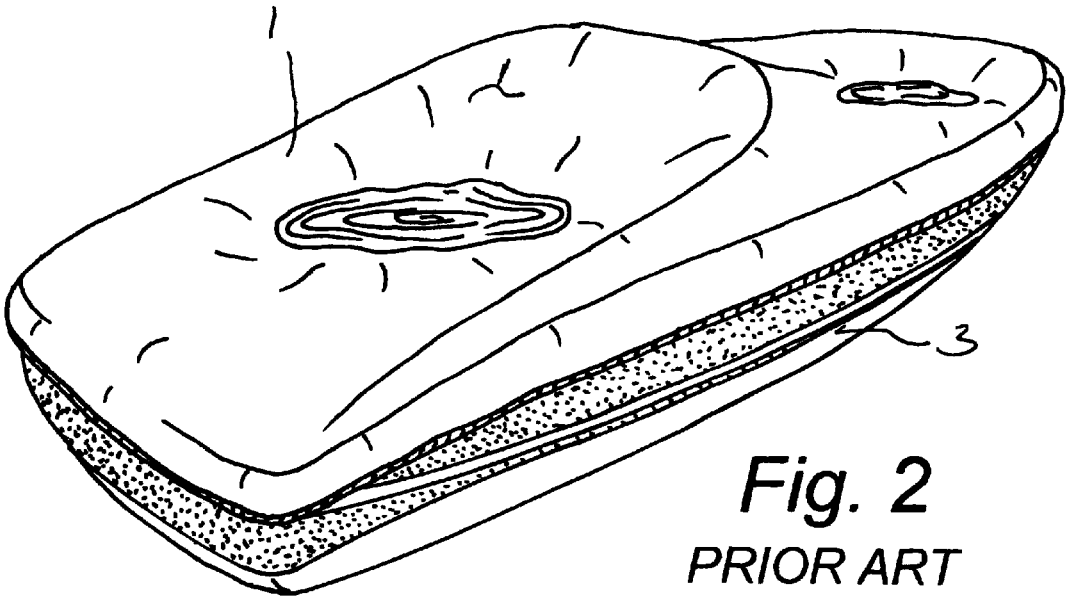
Fig. 2 PRIOR ART
FIG. 2 is a perspective view of the prior art where stretching of the cover allows cupping of water and possible tearing.
Figure 3:
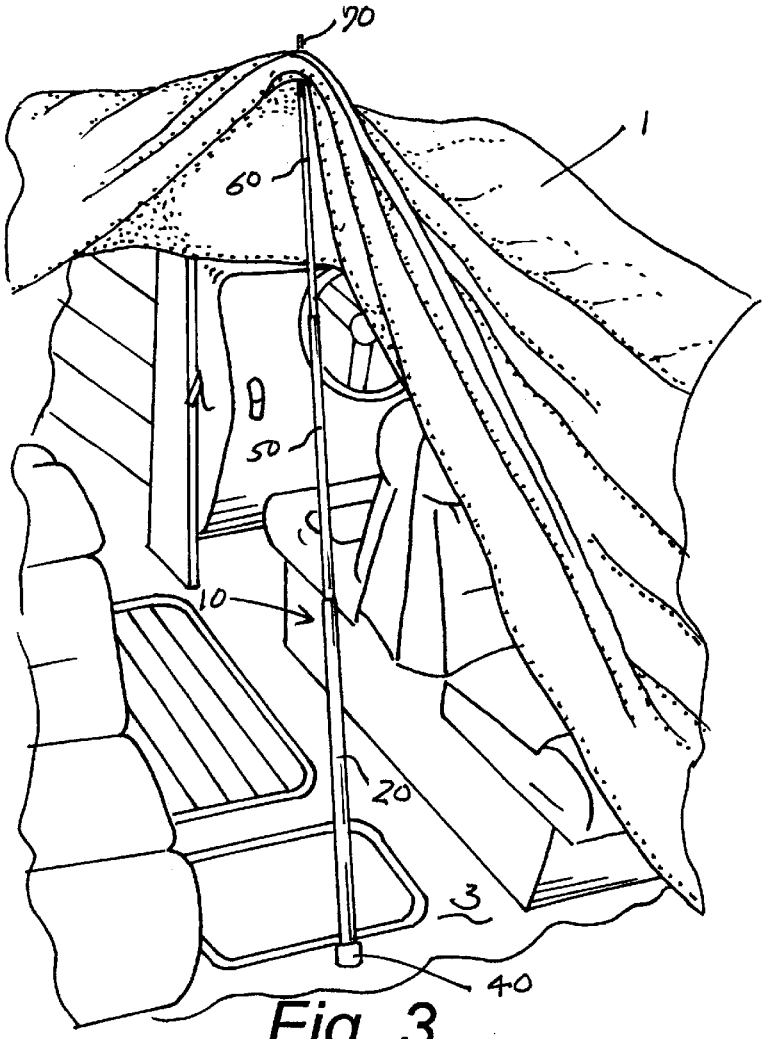
FIG. 3 is a partial perspective view illustrating a self-adjusting support pole being placed in position to support the boat cover.
Figure 4:
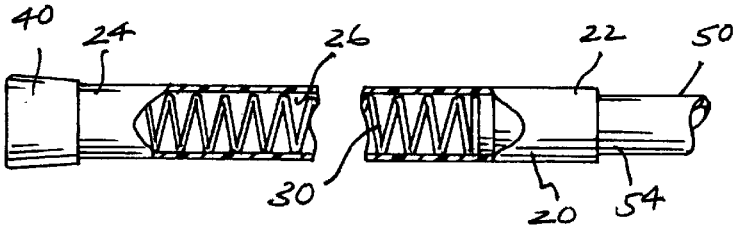
FIG. 4 is a partial perspective view of the support pole with portions cut away to show the spring disposed in the interior cavity of the base leg.
Figure 5:
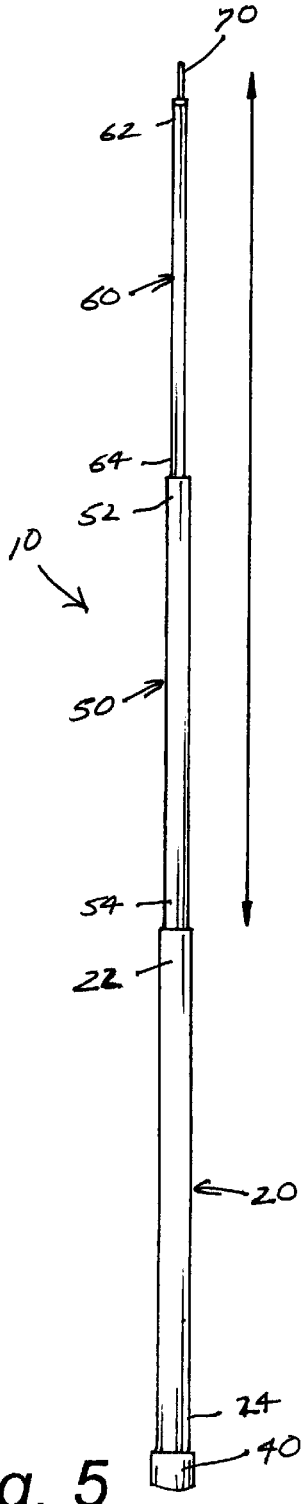
FIG. 5 is a side elevational view of the support pole.

As can be seen by reference to the drawings, and in particularly to FIGS. 3–5, the self-adjusting boat cover support pole that forms the basis of the present invention is designated generally by the reference number 10. The support poles 10 hold a boat cover 1 in a resiliently taut condition covering the upper portion of a boat hull 3 as shown in FIG. 1.

Each support pole 10 includes a tubular base leg 20 having an upper end 22, a lower end 24, and an interior cavity 26. A spring 30 is carried in the interior cavity 26 adjacent the lower end 24 and a rubber end cap 40 covers the lower end to provide a high-friction contact point with the deck of the boat.

A first tubular extension leg 50 having an upper end 52 and a lower end 54 is telescopically attached to the base leg 20. The lower end 54 operatively contacts and is upwardly biased by the spring 30. In an embodiment with no further extension legs, the upper end 52 of extension leg 50 would contact and support a section of the boat cover 1.

In the embodiment shown in FIGS. 3–5, the support 10 further includes a second tubular extension leg 60 having an upper end 62 and a lower end 64. The lower end 64 is telescopically received in and adjustably locked at any desired position to give an appropriate overall length. The locking may be accomplished by a twist lock structure or other known methods of locking one telescopic member with respect to another. A bayonet end 70 is carried at the upper end 62 of the second extension leg 60 and is received through a grommet opening in the boat cover 1 to secure the upper end 62 against movement with respect to the cover 1.

In use, the self-adjusting support poles 10 are positioned under the boat cover 1 at appropriate locations to hold the cover 1 in a resiliently taut condition. This facilitates attaching the boat cover 1 to the boat hull 3, eliminates stretching and resultant water cupping, and minimizes the potential for a support pole 10 to vibrate out of position and cause tearing.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A self-adjusting boat cover support pole in combination with a flexible boat cover having at least one grommet opening, the support pole consisting of:

an elongated tubular base leg having an upper end, a lower end, and an interior cavity;

a spring disposed within the interior cavity of the base leg adjacent its lower end;

a first elongated tubular extension leg having an upper end and a lower end, the first extension leg being telescopically attached to the base leg wherein the lower end of the first extension leg operatively contacts and is upwardly biased by the spring in a free floating manner; and, a second elongated tubular extension leg having an upper end and a lower end, the second extension leg being telescopically attached to the first extension leg and being captively adjustable with respect thereto; wherein, the upper end of the second elongated tubular extension leg is adapted to contact and support a section of the boat cover and is further provided with a bayonet end that is dimensioned to be received through said at least one grommet opening.

* * * * *